United States Patent [19]

Kaneshige

[11] Patent Number: 4,821,063

[45] Date of Patent: Apr. 11, 1989

[54] IMAGE FORMING APPARATUS

[75] Inventor: Masatoshi Kaneshige, Yamatokoriyama, Japan

[73] Assignee: Sharp Kabushiki Kaisha, Osaka, Japan

[21] Appl. No.: 49,397

[22] Filed: May 14, 1987

[30] Foreign Application Priority Data

May 20, 1986 [JP] Japan ..... 61-117903

[51] Int. Cl.[4] ..... G03G 15/00

[52] U.S. Cl. ..... 355/3 DD; 355/3 R

[58] Field of Search ..... 355/3 DD, 3 DR, 3 R, 355/14 D, 15

[56] References Cited

U.S. PATENT DOCUMENTS

| | | | |
|---|---|---|---|
| 4,386,838 | 6/1983 | Hirabayashi et al. | 355/3 DR |
| 4,563,074 | 1/1986 | Tsutsui et al. | 355/3 DD |

FOREIGN PATENT DOCUMENTS

| | | | |
|---|---|---|---|
| 3304768A1 | 2/1983 | Fed. Rep. of Germany . | |
| 3329714A1 | 8/1983 | Fed. Rep. of Germany . | |
| 0190960 | 11/1983 | Japan | 355/15 |
| 0061845 | 4/1984 | Japan | 355/3 DD |
| 63-10424 | 3/1988 | Japan . | |
| 2132942A | 7/1984 | United Kingdom . | |

*Primary Examiner*—A. T. Grimley
*Assistant Examiner*—Ed Pipala
*Attorney, Agent, or Firm*—Birch, Stewart, Kolasch & Birch

[57] ABSTRACT

An image forming apparatus including a developing unit for developing an electrostatic latent image formed on an image carrier, and an image forming unit. A mechanism is provided which permits the image forming unit and developing unit to be mounted on or dismounted from the image forming apparatus in the proper order. A developing unit-positioning guide 15 provided by first mounting the image forming unit on the image forming apparatus.

5 Claims, 6 Drawing Sheets

IMAGE FORMING APPARATUS

BACKGROUND OF THE INVENTION

The present invention relates to a device for mounting a developing unit which develops an electrostatic latent image formed on an image carrier in an imaging forming apparatus.

Conventionally, an image forming apparatus, such as an electrophotographic copying machine, forms an electrostatic latent image on a photoreceptor or an image carrier and develops the latent image normally with a black toner utilizing a developing unit. As the demand for monocolor development with various color tones such as blue or red toner as well as with black toner increases copying machines whose developing units are replaced according to the intended development color have been increasingly used in the recent years. As another new type of copying machine, the image forming means is supported integrally with the photoreceptor to form an image forming unit which can be removed from the copying machine. Such image forming units and copying machines adapted for these units have been already commercially produced. This type of copying machines does not require regular adjustment and replacement of the photoreceptor, charge wire used and of the waste toner container. Accordingly, maintenance is easy even for the user with no expertise.

When there are two or more units to be mounted in the copying machine mentioned above, they can be mounted in the wrong order. Mounting of the image forming unit and the developing unit in the wrong order can result in improper positioning of the developing unit with respect to the image forming unit or improper dispersion of toner from the magnetic brush of the developing unit, or in the worst case, can damage the copying machine.

SUMMARY OF THE INVENTION

An object of the present invention is to provide an image forming apparatus capable of positioning the developing means accurately in mounting it removably on the image forming apparatus.

Another object of the present invention is to provide an image forming apparatus capable of positioning the image forming means accurately when removably mounted it in the image forming apparatus.

Another further object of the present invention is to provide an image forming apparatus capable of having mounted therein an image forming unit and a developing unit in correct order and without causing damage.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, according to an embodiment of the present invention, an image forming apparatus comprises an image forming unit including an image carrier, a charging unit and a cleaning unit and a developing unit for developing an electrostatic latent image formed on the image carrier means for permitting the image forming unit and developing unit to be mounted on or dismounted from the image forming equipment in the preparation, and a developing unit-positioning means on the image forming unit for mounting the developing unit on the image forming apparatus.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Figure 1:
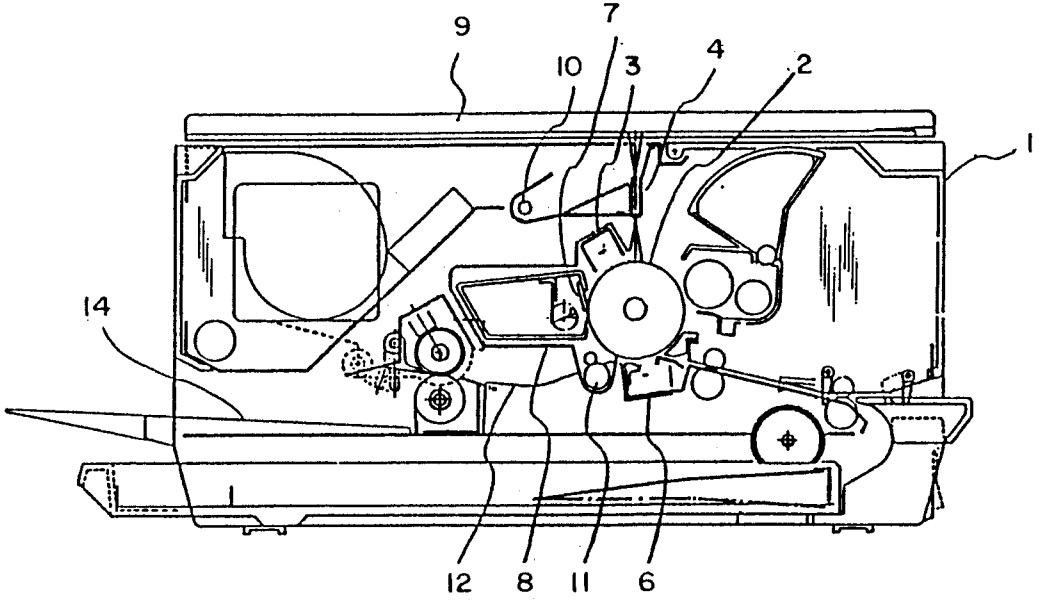
FIG. 1 is a sectional side view of an electrophotographic copying machine.

FIG. 1 is a sectional side view of an electrophotographic copying machine as an embodiment of the image forming apparatus of the present invention. In the approximate center, the copying machine 1 has a image carrier or photoreceptor 2 which is supported so as to be rotated clockwise by a driving mechanism (not shown). Around the photoreceptor 2 are arranged in the rotating direction a charger unit 3, a convergent light transmitter 4, a developing unit 5, a transfer unit 6 and a cleaning unit 7. In the copying machine 1, the photoreceptor 2, the charger units 3 and the cleaner unit 7 are retained in at least one case, constituting an image forming unit 8. The image forming unit 8 is held by a support guide means (not shown) of the copying machine body and mounted or dismounted easily by anyone on or from the copying machine 1 by a grip provided on the image forming unit 8. A manuscript rest 9 is provided movably on the top of the copying machine 1. A manuscript placed on the manuscript rest 9 is radiated by an exposure light source 10. The manuscript rest is driven laterally by a driving device (not shown). An optical image obtained by the light exposure is projected by means of the convergent light transmitter 4 onto the photoconductive layer of the photoreceptor, forming an electrostatic latent image corresponding to the image of the manuscript. The latent image is made visible by the developing unit 5. The transfer unit 6 transfers the visible (toner) image onto a paper transmitted in a timely manner from a paper feeder. The paper is separated from the photoreceptor 2 by a separator unit 11 and transmitted along a transport guide 12 to a thermal fixing device 13 which fixes the toner image on the copy paper by applying heat and pressure. Finally the copy paper is discharged to a copy paper discharge section 14.

Figure 2:
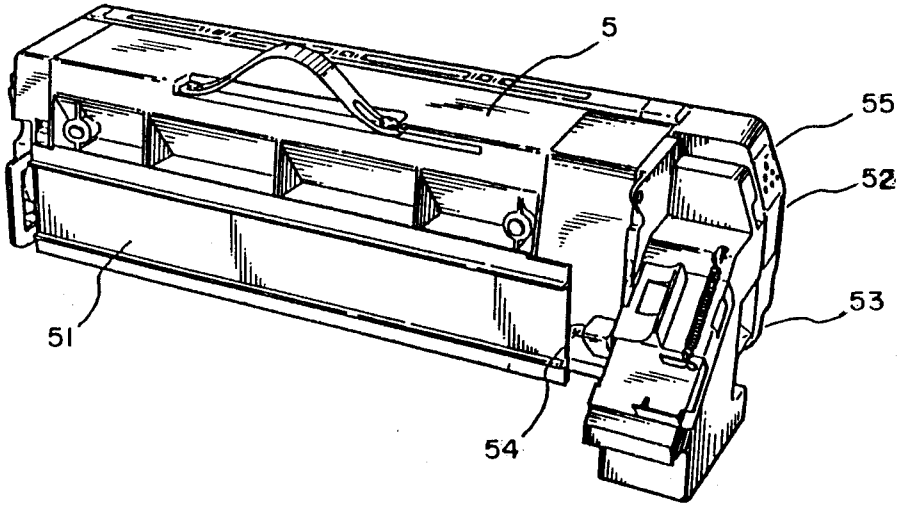
FIG. 2(A) is a perspective view of a developing unit.
FIG. 2(B) is a sectional view showing the locking mechanism of the developing unit.
Figure 2:
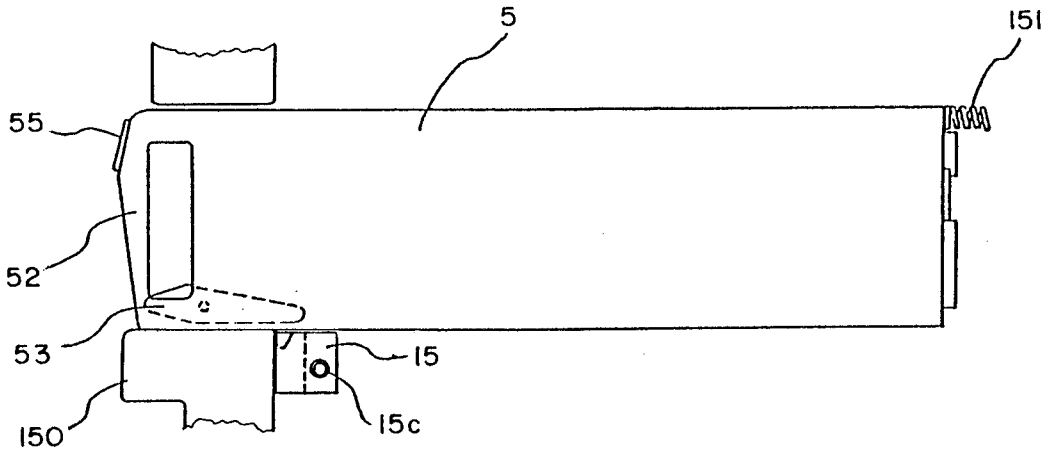

FIG. 2(A) shows the developing unit 5 entirely in a perspective view. Prior to mounting the developing unit 5 in the copying machine, a cover 51 is removed to expose a magnetic toner brush provided on the developing sleeve. The developing unit 5 is mounted in the copying machine, with a mounting grip 52 held by hand. When the developing unit 5 is mounted, a positioning boss 54 is locked in a positioning hole 8a (FIG. 3) formed in the image forming unit. The developing unit 5 is secured by a locking claw 53 to the copying machine. A color indicator 55 informs the operator of the color of the currently used toner. The color indicator 55 can be viewed through a window 1b provided in the front cabinet 1a of the copying machine. (See FIG. 3).

Figure 3:
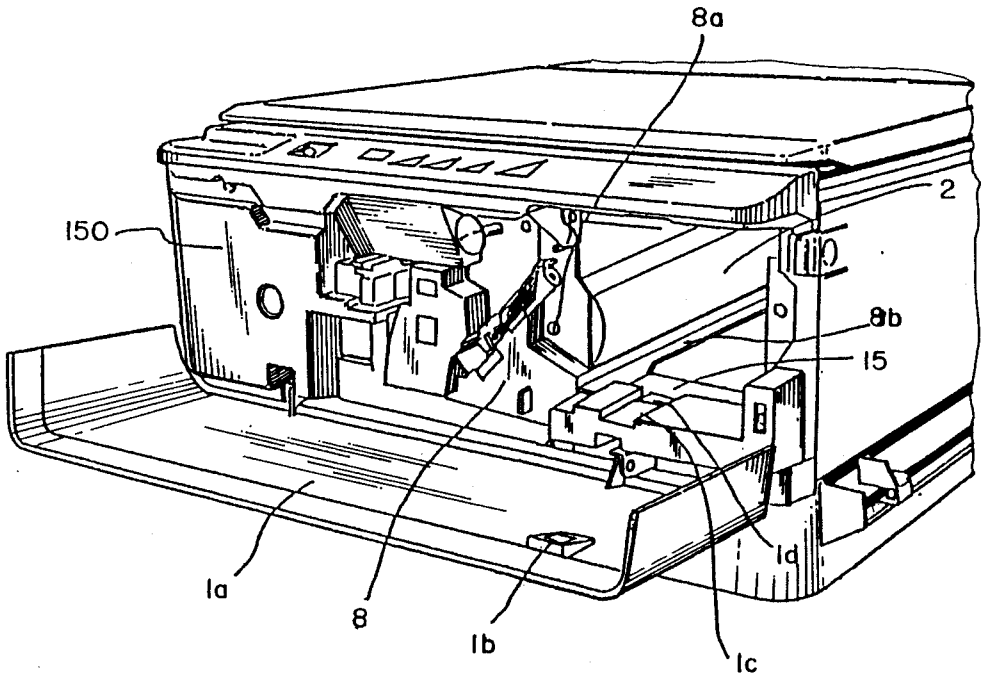
FIG. 3 is a perspective view of the copying machine in which the developing unit is mounted.
Figure 4A:
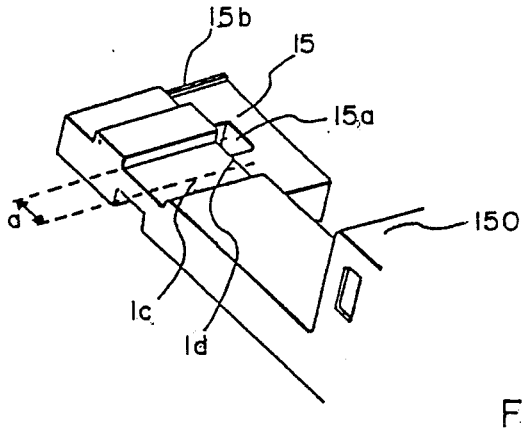
FIGS. 4(A), 4(B) and 4(C) explain the mechanism of preventing an erroneous mounting operation.
Figure 4B:
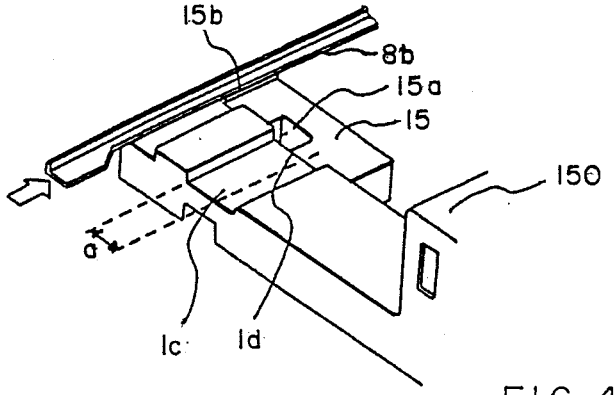

FIG. 3 shows the copying machine in which the image forming unit 8 is mounted. The image forming unit 8 comprises the charger 3, photoreceptor 2 and the cleaner unit 7 for removing residual toner from the photoreceptor surface housed in at least one case. Mounting of the developing unit 5 is made possible by first mounting the image forming unit 8 in the copying machine. While guiding the developing unit 5 into the copying machine, the guide 8b provided on the image forming unit 8, helps ensure accurate positioning of the magnetic development brush developer with respect to the photoreceptor surface, together with the positioning boss 54 of the developing unit 5. A block 15 prevents the image forming unit 8 and the developing unit 5 from being mounted in the wrong order, or specifically, prevents the developing unit 5 from being mounted prior to the image forming unit 8; as described earlier, an optimum image forming condition is realized by positioning the developing unit 5 in relation to the image forming unit 8 which is positioned in advance in the copying machine. As shown in FIG. 4, the block 15 is mounted movably on the copying machine 1 and forced to the left in FIGS. 4(A) and 4(B) by a spring 15c of FIG. 2(B). Accordingly, as shown in FIG. 4(A), a cut-away portion 15a in the block 15 is out of alignment with a guide groove 1c formed in the copying machine frame 150. The block 15 has a raised member 15b by which the block 15 can be moved to the right. The guide 8b is formed on the image forming unit 8 to correspond with the raised member 15b. As shown in FIG. 4(B), the width of the guide 8b increases gradually from the insertion leading end toward the rear end of the image forming unit 8. Accordingly, as the image forming unit 8 is inserted, the guide 8b pushes the raised member 15b of the block 15, forcing the block 15 to the right. As a result, the cut-away portion 15a of the block 15 is made to align with the guide groove 1c of the frame 150. The locking claw 53 is provided on the developing unit 5 at the position corresponding to the guide groove 1c of the frame 150. Therefore, when the image forming unit 8 is mounted in the copying machine so that the cut-away portion 15a of the block 15 is aligned with the guide groove 1c of the frame 150, the locking claw 53 of the developing unit 5 drops into the cut-away portion 15a.

The procedure of mounting the developing unit 5 is described now. After the image forming unit 8 is loaded in the copying machine 1, the developing unit 5 is inserted into the copying machine 1 along the guide groove 1c formed in a part of the machine frame 150. The developing unit 5 is further led by the guide 8b of the image forming unit 8 until it is linked with the developing unit driving means (not shown) provided in the depth of the copying machine. Simultaneously, the positioning boss 54 of the developing unit 5 engages the positioning hole 8a formed in the image forming unit support, so that the developing unit 5 is accurately positioned. In this state, however, the developing unit 5 is not restricted in the insertion direction, and the developing unit 5 can be removed from the copying machine. It is secured by the locking claw 53 which engages the edge 1d of the guide groove 1c formed in the machine frame, as shown in FIG. 2(B).

Figure 4C:
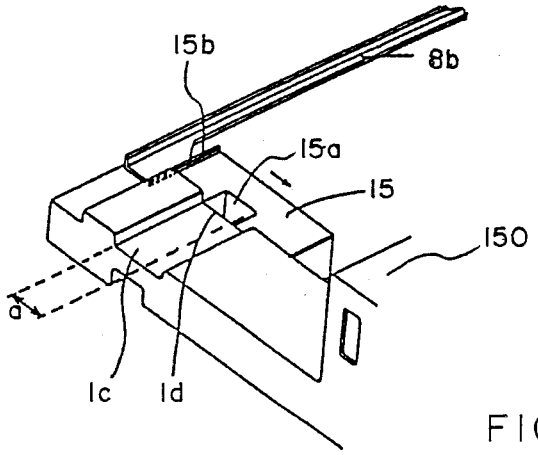

FIGS. 4(A) through 4(C) explain the mechanism of preventing an erroneous mounting operation. FIG. 4(A) shows the state of the mechanism when the image forming unit 8 is not mounted. The block 15 is forced into this position by means of a spring (not shown). If the developing unit 5 is inserted during this state, the locking claw 53 does not drop in the cut-away portion 15a and therefore does not engage the edge 1d of the machine frame 150. Namely, the developing unit 5 will not lock. As a result, the developing unit 5 will be removed from the copying machine due to a spring 151 (FIG. 2(B)) mounted on the rear frame of the copying machine. (The distance "a" between the broken lines corresponds to the width of the locking claw 53.)

FIG. 4(B) shows the state of the mechanism when the image forming unit 8 is being inserted in the direction of the arrow into the copying machine frame. At this stage as well, the block 15 is not in a position to permit the locking claw 53 of the developing unit 5 to engage the cut-away portion 15a or the edge 1d.

FIG. 4(C) shows the state when mounting of the image forming unit 8 is completed. Since the rear portion of the guide 8b on the image forming unit 8 is wider than the front portion, the guide 8b pushes the block 15 towards the right when the image forming unit 8 has been mounted. As a result, the cut-away portion 15a of the block 15 is aligned with the guide groove 1c, ready for the locking craw 53 to drop in the cut-away portion 15a. When the developing unit 5 is inserted, the locking claw 53 comes into engagement with the edge 1d of the copying machine frame, locking the developing unit 5 against the above mentioned spring force.

Figure 5:
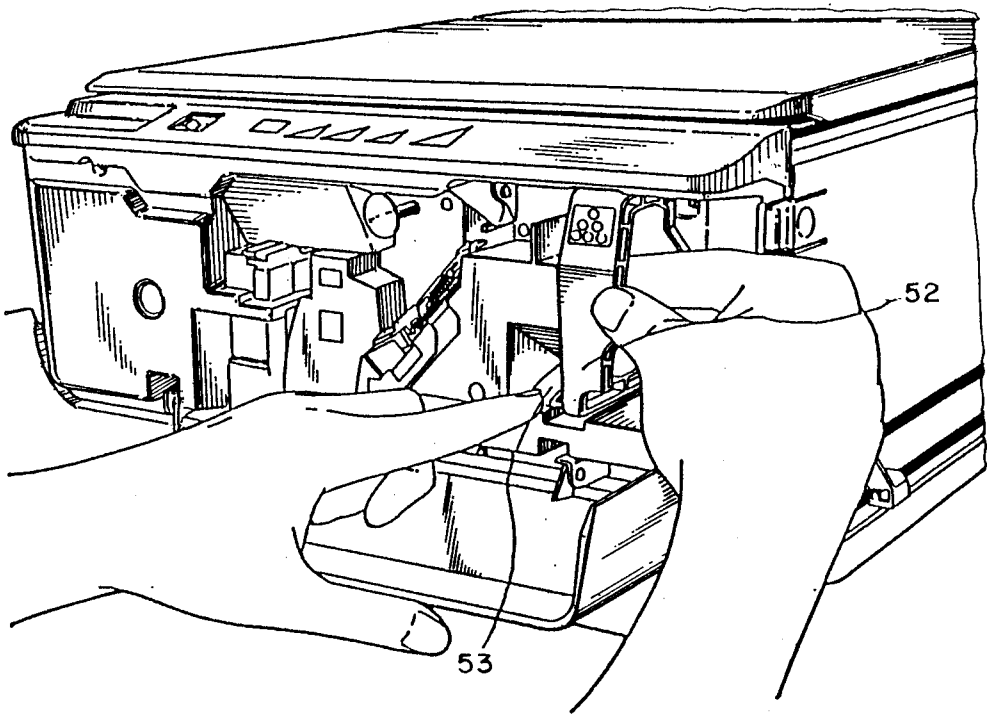
FIG. 5 is a perspective view of the copying machine showing the developing unit being removed.

FIG. 5 shows the procedure of removing the developing unit 5. The locking claw 53 is released from the machine frame, when depressed. Then the developing unit 5 can be removed easily by the grip 52.

According to the present invention, as understood from the above, the developing unit 5 cannot be set in place unless the image forming unit 8 has been mounted. Mounting of the units in wrong order can be prevented by a simple mechanism without involving a special preventive device.

While only certain embodiments of the present invention have been described, it will be apparent to those skilled in the art that various changes and modifications may be made therein without departing from the spirit and scope of the present invention as claimed.

What is claimed is:

1. An image forming apparatus comprising:

a detachable image forming unit including an image carrier, a detachable developing unit for developing an electrostatic latent image formed on said image carrier, a guide groove formed on a frame portion of said image forming apparatus for receipt of said developing unit, a guide means provided on said image forming unit for guiding said developing unit into said image forming apparatus, and means for preventing said developing unit from being mounted prior to the mounting of said image forming unit, said means including a cut-away portion, which preventing means upon being engaged by said guide means upon mounting of said image forming unit is moved so as to align said cut-away portion with said guide groove of said frame.

2. The image forming apparatus of claim 1, wherein said developing unit includes a locking means which engages said cut-away portion upon the completion of the mounting of said developing unit.

3. The image forming apparatus of claim 1, wherein said developing unit further includes a positioning boss.

4. The image forming apparatus of claim 1, wherein said guide means increases in width gradually from an insertion leading end thereof toward the rear end of said image forming unit.

5. The image forming apparatus of claim 1, wherein said image forming unit is retained by a single support.

* * * * *